United States Patent [19]

Kraft

[11] 3,991,598

[45] *Nov. 16, 1976

[54] METHOD OF ROLLER SPINNING CUP-SHAPED METAL BLANKS

[75] Inventor: Derald H. Kraft, Canton, Ohio

[73] Assignee: Aspro, Inc., Canton, Ohio

[ * ] Notice: The portion of the term of this patent subsequent to Sept. 21, 1993, has been disclaimed.

[22] Filed: June 6, 1975

[21] Appl. No.: 584,388

[52] U.S. Cl. ..... 72/83; 29/159 R; 113/116 D

[51] Int. Cl.[2] ..... B21D 22/14; B21D 29/02

[58] Field of Search ..... 29/159 R; 72/82, 83; 74/230.8; 113/116 D

[56] References Cited

UNITED STATES PATENTS

| | | | |
|---|---|---|---|
| 2,075,294 | 3/1937 | Le Jeune | 29/159 R |
| 3,225,425 | 12/1965 | Skinner et al. | 29/159 R |
| 3,282,078 | 11/1966 | Kaesemeyer | 29/159 R X |
| 3,700,382 | 10/1972 | Pacak | 29/159 R |
| 3,823,591 | 7/1974 | Schröder et al. | 29/159 R X |
| 3,893,818 | 7/1975 | Mickus | 29/159 R |

*Primary Examiner*—Victor A. DiPalma
*Attorney, Agent, or Firm*—Frease & Bishop

[57] ABSTRACT

A method of making a dynamically balanced cup-shaped blank for use in the production of a V-grooved pulley, from a flat sheet metal disc by a roller spinning tool. The disc is provided with a central hole for mounting the disc on rotating die means between headstock and tailstock die form assemblies of a spinning machine. The spinning tool presses the disc against an end of a headstock die form and moves generally radially outwardly pressing a portion of the disc against the end of the die form to provide a bottom wall of the desired cup-shaped blank. The spinning tool then moves in a series of passes along the headstock die form thereby rolling, forming and ironing rotating outer metal portions of the disc against the die, and forming the disc with an annular reversely angled conical flange and an axially extending cylindrical side wall which terminates in an open end. The die form and spinning tool also form a reentrant corner in the disc blank which connects the conical flange with the cylindrical wall and which is defined by an acute angle with the cylindrical side wall. The conical flange ultimately forms a portion of one of the flanges of a V-groove in a finished pulley subsequently spun from the cup-shaped stage blank. The open end of the cylindrical side wall then is trimmed to a predetermined length to provide the desired wall length in which one or more V-grooves will be spun, to form a finished dynamically balanced, spun V-grooved pulley.

10 Claims, 18 Drawing Figures

METHOD OF ROLLER SPINNING CUP-SHAPED METAL BLANKS

BACKGROUND OF THE INVENTION

1. Field of the Invention

The invention relates to a method of forming a cup-shaped metal object of special cross sectional configuration from a flat sheet metal disc. More particularly, the invention relates to the method of roller spinning a dynamically balanced cup-shaped metal stage blank for subsequent use in spinning a V-grooved pulley, in which a reversely angled conical flange is roller spun in the disc blank adjacent a cylindrical side wall, which conical flange forms a portion of final V-groove of a spun pulley.

2. Description of the Prior Art

Many procedures have been used and are known for the formation of cup-shaped metal blanks from flat sheet metal discs, which blanks in turn are used in the manufacture of V-grooved pulleys, or similar articles. Many of these procedures involve stamping, drawing and slitting operations, examples of which are shown in U.S. Pat. Nos. 1,766,098, 2,330,228, 2,493,053 and 3,080,644.

Cup-shaped stage blanks for V-grooved pulleys produced by such prior stamping and drawing methods are not balanced dynamically since the blanks are formed by a series of progressive die steps on a non-rotating blank.

Other procedures and apparatus have been known for directly spinning cup blanks and V-groove pulleys from flat metal discs for producing dynamically balanced V-grooved pulleys, as shown in U.S. Pat. No. 1,728,002. The equipment and dies required, however, involves headstock dies with sliding and movable members which considerably increase the cost of pulley manufacture with such apparatus.

Likewise, these dies require means on the machine for controlling movement of the disc components which contribute to the increased costs and involve maintainence problems. Also, considerable tooling costs are involved to provide various dies from which to produce a variety of cup blanks, since a different die size and configuration is required for each type of cup blank produced.

Several other known procedures for spinning objects from flat sheet metal blanks are known, such as the procedure in U.S. Pat. No. 3,195,491 for spinning rounded bowl-like blanks from discs in producing tapered disc wheels. Conical-shaped metal objects are produced by roller spinning procedures in U.S. Pat. No. 3,104,640. The disc wheel or conical shaped metal objects produced by such methods have tapered or curved side walls which are not suitable for V-grooved pulley manufacture. U.S. Pat. No. 3,282,078 uses tubular-shaped blanks instead of flat metal discs to spin grooved objects. This procedure flows the metal by thinning the sidewalls of the tubular blank to form an enlarged curved end groove.

Such prior art equipment and processes appear to be satisfactory for their intended use especially where vast quantities of cup-shaped blanks and finished spun products are made at high production rates. Such vast quantities spread the cost of the equipment, dies and tooling which is expensive over the large numbers of units produced.

It is desirable in certain situations and locations to be able to produce a relatively small quantity of cup-shaped metal blanks for subsequent use in spinning V-grooved pulleys with inexpensive, low volume producing equipment and methods. Furthermore, it is desirable to be able to change the size and configuration of the cup-shaped blank produced with a minimum tooling cost, so that small quantities of various sizes and configurations of cup-shaped blanks can be produced by a relatively low initial and replacement cost for equipment, tooling and dies.

The cup-shaped metal stage blanks for V-groove pulley manufacture produced by known drawing, die stamping and similar forming procedures preferably have flat bottom walls or hub connecting portions. The bottom wall is connected with a cylindrical side wall by an angled conical flange groove or annular shoulder formation such as shown in the cup-shaped pulley blanks of U.S. Pat. Nos. 3,826,804, 3,869,223 and 2,892,431. The conical flange, cylindrical side wall and shoulder formations, broadly may be termed a reentrant conical flange which provides an annular flange portion of one of the V-grooves in the finished pulley spun from the stage blank shown in these patents.

No known method of which I am aware enables the production of relatively small quantities of various sizes and configurations of cup-shaped metal stage blanks by roller spinning flat sheet metal discs on a usual and simple type of metal spinning machine, for use in the subsequent spinning of V-groved pulleys; which cup-shaped blanks are dynamically balanced due to their formation by roller spinning, and in which an annular groove or conical reentrant flange formation which provides a portion of the final pulley groove flange is formed during the spinning procedure in the cup-shaped stage blank.

SUMMARY OF THE INVENTION

Objectives of the invention include providing new methods and procedures for the manufacture from a simple, single sheet metal blank, a metal cup-shaped object for use in the subsequent manufacture of V-grooved pulleys; providing a procedure for the manufacture of a dynamically balanced cup-shaped metal blank by roller spinning, in which the blank if formed with an annular reentrant conical flange which extends outwardly with respect to a flat bottom wall of the cup-shaped object, and in which the reentrant flange forms a portion of one side flange of a V-groove subsequently spun into a cylindrical side wall flange of the cup-shaped blank; providing such a procedure which enables small quantities of cup-shaped pulley blanks to be produced on relatively inexpensive and simple lathe-type metal spinning or turning machines with a minimum of tooling costs, requiring basically a headstock die form having an outer configuration complementary to the internal shape of the cup-shaped metal blank, and a pressure forming roller for laying the metal of a flat disc blank against the headstock die form during a series of passes of the roller with respect to the die form; providing such a procedure which requires only replacing the headstock die form on the spinning machine to make various sizes and configurations of cup-shaped pulley blanks for subsequent spinning into different sizes and configurations of V-grooved pulleys, which enables rapid and inexpensive changeover to produce such different pulley blanks; providing such a procedure which preferably may be automatically program controlled enabling an unskilled workman to operate a plurality of such metal cup blank spinning machines for carrying out the steps of the improved method; and providing a new procedure and method for making such dynamically balanced pulley blanks having a flanged portion of the final spun V-groove formed in the blank during the spinning procedure, which eliminates difficulties heretofore encountered, achieves the various objectives indicated in a practical workable and easily controlled manner, and which solves problems and satisfies needs which have long existed in the art.

These objectives and advantages are obtained by the improved pulley blank manufacturing procedures for making a cup-shaped sheet metal pulley blank of the type having a bottom wall and a connected outer cylindrical side wall terminating in an open end, from a flat sheet metal disc with pressure roll forming means, for use as a stage blank for forming V-groove pulley, the general nature of which may be stated as including the steps of, providing a flat sheet metal disc having a central hole formed therein; clamping a central portion of the disc around the hole between opposed relatively axially movable complementary clamping faces of rotatable headstock and tailstock die form means wherein the headstock die means also has cylindrical flange-forming means and reentrant conical flange-forming means connected with the cylindrical flange-forming means by a reentrant corner acutely angled in cross section; rotating the die means and clamped disc; pressure rolling, forming and ironing the rotating annular disc metal portions surrounding said central portion against the headstock die form means cylindrical and conical flange-forming means and the connected reentrant corner to form a cup-shaped blank with a flat bottom wall and a connected annular reversely angled conical flange portion terminating in an axially extending open-ended cylindrical side wall which extends in cross section in acutely angled reentrant corner relation relative to the conical flange portion; and then while continuing rotation of the die means and clamped blank, trimming the open end of the cylindrical side wall to predetermined axial length with respect to the acutely angled reentrant corner.

BRIEF DESCRIPTION OF THE DRAWINGS

Preferred method steps of the invention — illustrative of the best modes in which applicant has contemplated applying the principles — are illustrated in the drawings and set forth in the following description, and are particularly and distinctly pointed out and set forth in the appended claims.

Similar numerals refer to similar parts throughout the drawings.

DESCRIPTION OF THE PREFERRED EMBODIMENT

Figure 1:
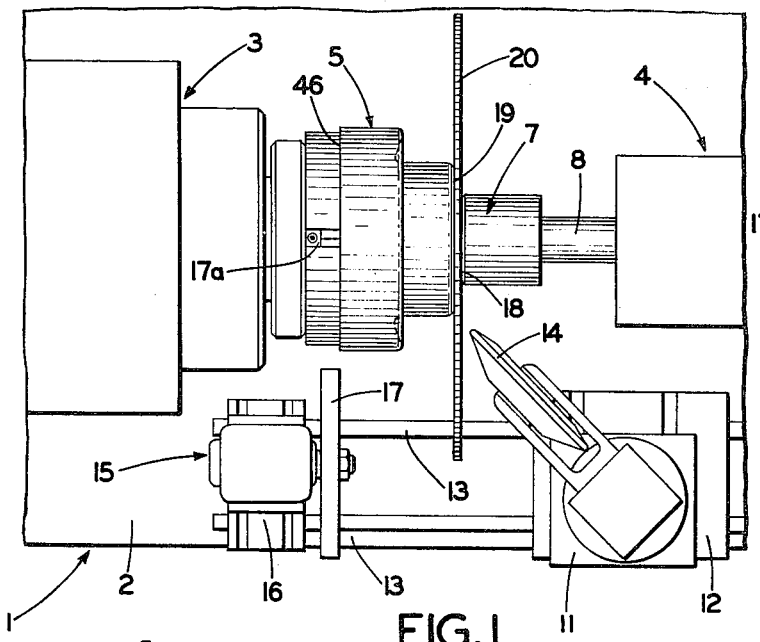
FIG. 1 is a fragmentary diagrammatic top plan view of portions of a type of simple spinning machine which may be used to carry out certain steps of the new procedure.

A portion of a typical simple lathe type spinning machine for carrying out the steps of the improved roller forming method is shown in FIG. 1 and is indicated generally at 1. Spinner 1 includes a bed 2, a headstock assembly 3 and a tailstock assembly 4. A headstock die form 5 is mounted on headstock assembly 3 and is rotated by a motor driven shaft (not shown).

Figure 2:
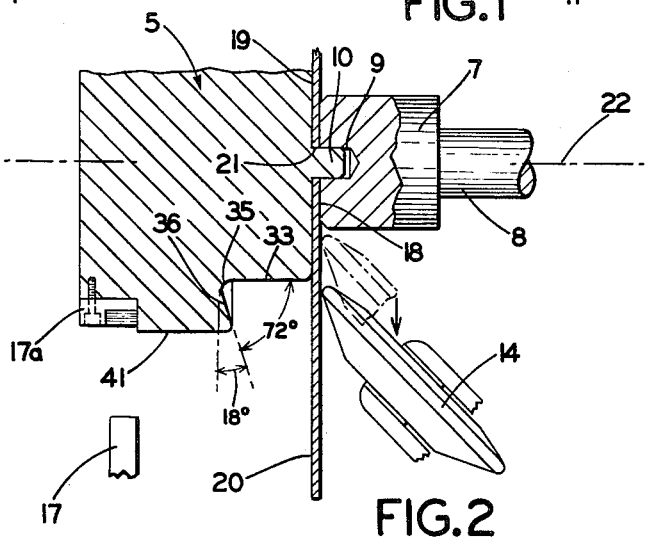
FIG. 2 is a somewhat diagrammatic fragmentary sectional view of a flat sheet metal blank disc mounted between headstock and tailstock dies of the spinning machine shown in FIG. 1, and showing the spinning of the flat bottom wall of the cup-shaped pulley blank produced by the improved procedure.

Tailstock assembly 4 preferably has a die form 7, axially movable by a piston rod 8. An aperture 9 is formed in tailstock dye 7 for receiving a pilot pin 10 formed on and extending axially outwardly from the center of the headstock die 5 (FIG. 2).

A tool holder 11 is movably mounted on a cross feed carriage 12 which in turn is movably mounted on a pair of guide rods 13 for longitudinal axial movement between headstock 3 and tailstock 4. A pressure spinning roller 14 is rotatably mounted on tool holder 11 and is movable in both parallel and transverse directions with respect to the longitudinal axis of spinning machine 1 by manipulation along cross feed carriage 12 and guide rods 13.

A metal trimming wheel assembly 15 is mounted on a second cross feed carriage 16 which in turn is mounted on guide rods 13. Assembly 15 includes a wheel 17 for trimming the edge portions of the cup-shaped blank produced in accordance with the procedures set forth below. Assembly 15 may be of the type shown in U.S. Pat. No. 2,702,597.

The particular construction and arrangement of machine 1 and the components thereof, may be modified and changed without effecting the concept of the invention. The important feature brought out by the construction of machine 1 shown in FIG. 1 is the relative simplicity thereof in contrast with the known complex prior art spinning machines used for a variety of spinning procedures.

Figure 7:
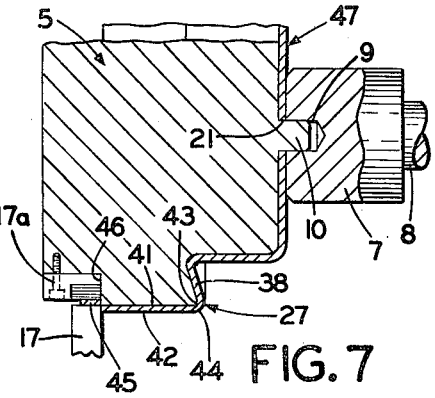
FIG. 7 is a view similar to FIGS. 2–6 showing a trimming operation being performed on the open end portion of the completed cup-shaped metal blank.
Figure 9:
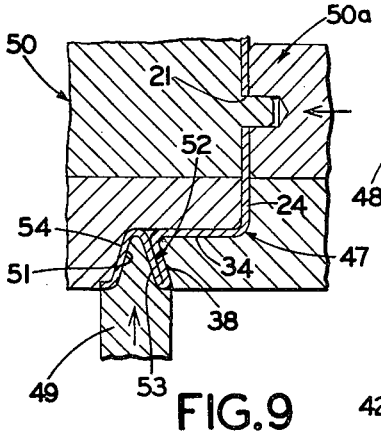
FIG. 9 is a generally diagrammatic, fragmentary view showing the formation of a pulley V-groove in the cylindrical side wall of the cup-shaped metal blank produced by the steps of the improved method.
Figure 8:
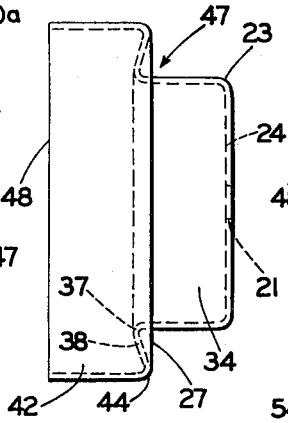
FIG. 8 is a side elevational view of the dynamically balanced roller spun cup-shaped metal pulley blank formed from the flat metal disc by the roller spinning steps shown in FIGS. 2–7.
Figure 10:
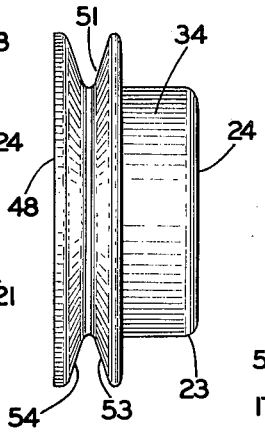
FIG. 10 is a side elevational view of a spun V-grooved pulley formed from the cup-shaped blank of FIG. 8.

The improved roller spinning procedure is set forth diagrammatically in FIGS. 2–7, with the roller spun cup-shaped pulley blank produced thereby being shown in FIG. 8, and with a spun V-grooved pulley being shown in FIGS. 9 and 10.

A flat sheet metal disc blank 20 having a generally uniform metal thickness, as shown in FIG. 1, is clamped between a circular end face 18 of tailstock die 7 and a larger circular flat face 19 of headstock die form 5 by actuation of a hydraulic cylinder or the like controlling piston rod 8. Pilot pin 10 projects through a central hole 21 formed in disc 20 and into aperture 9 of tailstock die 7 to properly align and center disc 20 on headstock die 5 of spinning machine 1.

The forming tool or roller 14 is guided into contact with the central portion of rotating blank disc 20 which is adjacent to and surrounding tailstock die 7, as shown in dot-dash lines in FIG. 2, by the concurrent movement of cross carriage 12 and tool holder 11 until pressure is exerted on disc 20. Roller 14 then moves in a transversely, radially outwardly extending direction with respect to the longitudinal axis 22 of machine 1, forcing the annual portion of disc 20 surrounding the clamped central portion against the outer periphery of flat end face 19 of die 5. Sufficient pressure is exerted by roller 14 on disc 20 during this outward radial movement to iron out any indentation gauge variation or other irregularity of disc 20 without materially reducing the original metal thickness of disc 20, and to form the dynamically balanced, central, flat bottom wall portion 24 of the cup-shaped blank being produced.

Figure 3:
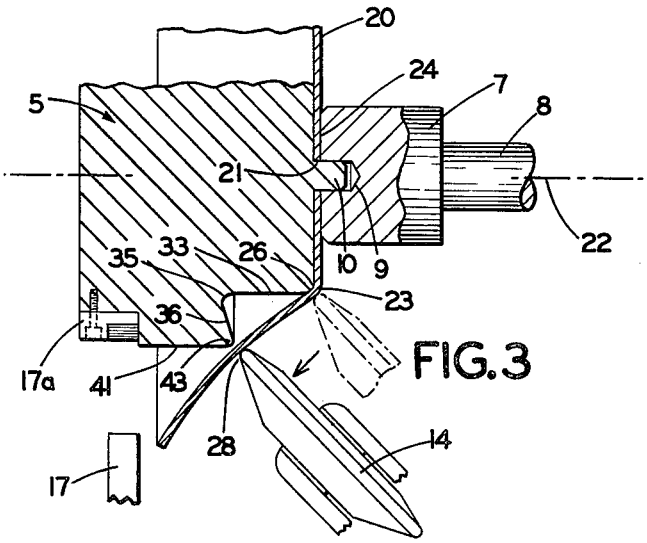
FIG. 3 is a view similar to FIG. 2 showing a step of the improved roller spinning operation in which an intermediate portion of the blank disc is being layed along the headstock die form preparatory to forming a reentrant conical pulley groove flange therein.

Carriage 12 then moves longitudinally along guide rods 13 forwardly toward headstock die 5 simultaneously with the radially outward movement of tool holder 11, causing roller 14 to follow the general diagonal path as shown in FIG. 3. Roller 14 works and forms the outer annual portion of disc 20 which surrounds the flat bottom wall portion 24 forwardly against the headstock die to start the formation of a generally right angled corner 23 against complementary corner 26 of die end face 19. The outermost end portion of disc 20 will curve outwardly as shown in FIG. 3 during the spinning and working or the metal since it is unrestrained in the axial and outer radial directions.

Figure 6:
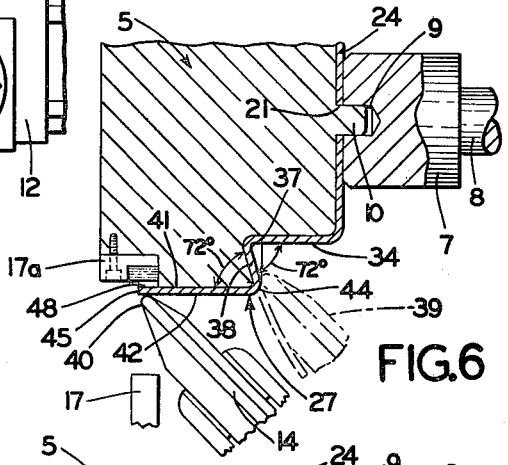
FIG. 6 is a view similar to FIGS. 2–5 showing another step of the improved roller spinning method completing the formation of the reentrant flange and the cylindrical terminal flange wall of the cup-shaped blank.
Figure 5:
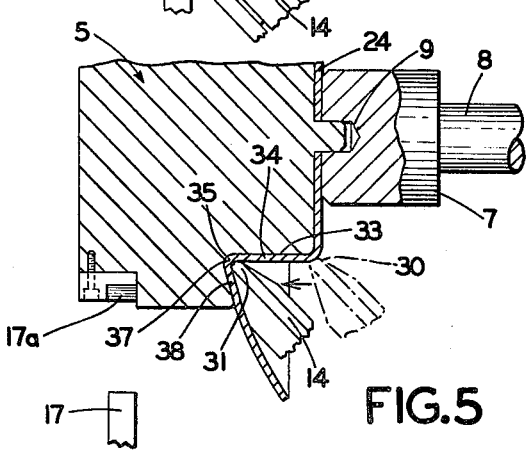
FIG. 5 is a view similar to FIGS. 2–4 showing the steps completing the formation of the reentrant flange and of forming a cylindrical hub wall in the disc blank connecting the bottom wall and reentrant flange.
Figure 4:
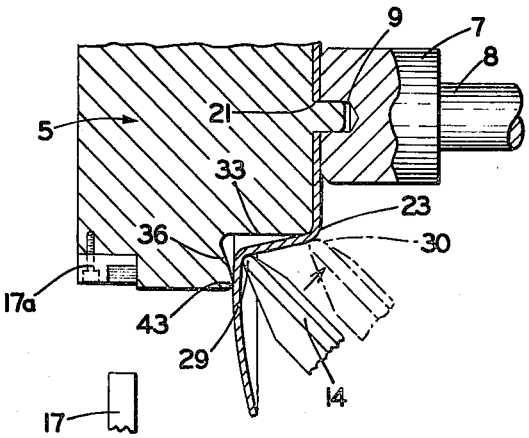
FIG. 4 is a view similar to FIGS. 2 and 3 showing the start of forming the reentrant conical pulley groove flange in the disc blank.

In accordance with the invention, the next series of operations or steps of the improved process forms a reentrant flange-corner configuration indicated generally at 27 in disc 20 (FIGS. 4, 5 and 6). Roller 14 moves generally simultaneously inwardly and rearwardly from its full line position indicated at 28 (FIG. 3), to the full line position 29 (FIG. 4), and then to the dot-dash line position 30 adjacent corner 23. Roller 14 then moves generally axially forwardly (FIG. 5) from position 30 to the full line position 31 forming and ironing the metal of an intermediate portion of the disc along and against a first cylindrical side wall 33 of die 5. This metal working forms an axially extending cylindrical hub portion 34 integrally connected to the metal blank end wall 24 by corner 23.

Roller 14 then forms, irons and presses a portion of the metal of disc 20 into an acutely angled corner 35 formed in die form 5 which connects cylindrical die wall 33 with a reentrant conical flange forming die wall 36. This working forms a complementary acute angled corner 37 and conical reentrant flange 38 in disc 20 adjacent cylindrical hub wall 34, with corner 37 connecting cylindrical hub wall 34 and reentrant flange 38 at an approximately 72° included angle.

Roller 14 then moves generally longitudinally rearwardly from the dot-dash position 39 (FIG. 6) to the full line position 40 forming and laying down the remaining outer portion of disc 20 (shown in dot-dash lines, FIG. 6) against a second cylindrical side wall 41 of die 5, forming a cylindrical cup side wall 42 in the cup-shaped blank being formed from disc 20.

A reentrant corner 43 provided on die form 5 forms a matching reentrant corner 44 in the disc during the forming and ironing of the disc metal along the die cylindrical side wall 41. Reentrant corners 43 and 44 form included acute angles in cross section (FIG. 6) of approximately 72° between reentrant die flange 36 and die side wall 41 and reentrant blank flange 38 and blank side wall 42, respectively.

Likewise, complementary corners 35 and 37 of die 5 and disc 20 form an included acute angle 72° between die wall 33 and reentrant die flange 36, and cylindrical hub wall 34 and reentrant disc flange 38, respectively. Cylindrical walls 33 and 34 of die 5 and disc 20 are concentric with cylindrical walls 41 and 42 of die 5 and disc 20, respectively, but of a smaller diameter and are connected thereto by reentrant flanges 36–38, and corners 35–37 and 43–44, respectively.

The next step involves the trimming of the extended somewhat irregular end 45 of side wall 42 which forms the cup end opening 48 to a predetermined axial length by moving trimming wheel 17 of trim assembly 15 radially inwardly on cross feed carriage 16, as shown diagrammatically in FIG. 7. Die 5 preferably has an annular shoulder 46 formed adjacent the end of cylindrical wall 41 with one or more trim blades 17*a* mounted thereon. Wheel 17 trims an annular ring end section 45 from cylindrical wall 41 which is subsequently cut into pieces by blade 17*a* in a somewhat similar manner as described in U.S. Pat. No. 2,702,597.

The dynamically balanced cup-shaped blank 47, indicated generally at 47 (FIG. 8), which is roller spun in accordance with the steps of the improved method, comprises the flat circular bottom wall 24, and cylindrical hub portion 34 which is joined to bottom wall 24 by right-angled corner 23 and to cylindrical side wall 42 by reentrant flange 38. Flange 38 in turn is connected to concentric cylindrical walls 34 and 42 by corners 37 and 44. The metal thickness of disc 20 is maintained during the forming of bottom wall 24, hub portion 34, side wall 42, reentrant flange 38, and connecting corners 23, 37 and 44 as shown in FIGS. 1–7, with only the non-uniformities and gauge variations being reduced during the spinning procedures.

Dynamically balanced cup-shaped blank 47 then may be removed either manually or automatically, from die 5 of spinning machine 1 and placed on a pulley forming headstock die assembly 50, only a portion of which is shown in FIG. 9, which preferably is mounted on a second or different spinning machine.

A V-groove forming roll 49, or a plurality of rough and finishing pulley groove forming rolls of the type shown in U.S. Pat. No. 2,826,804, is moved transversely radially inwardly engaging the midpoint of cylindrical wall 42 of pulley blank 47 (FIG. 9). Roll 49 in combination with the axial movement of a tailstock die assembly 50*a* forms a V-groove 51 in the blank wall 42. Reentrant flange 38 forms a double thickness flange wall 52 of V-groove 51 together with a matching second flange portion 53 formed from a portion of the metal of cylindrical wall 42. An opposite V-groove flange wall 54 formed from cylindrical wall 42 completes the formation of V-groove 51.

A plurality of V-grooves 51 can be accomodated in cylindrical side wall flange 42 of cup-shaped blank 47 merely by starting with a large diameter blank disc 20, thereby increasing the axial length of cylindrical flange 42 in the final spun blank 47. Multiple grooves may be formed as described in U.S. Pat. Nos. 2,869,223 and 3,852,863. Likewise, additional reentrant flange-corner configurations, similar to 27, can be formed in blank 47 with accompanying axially extending cylindrical flanges, concentric with and of greater diameter than flange 42.

Types, styles and configurations of dynamically balanced cup-shaped spun metal pulley blanks other than the particular configuration of blank 47, can be produced by the improved spinning method, in which a modified form of spun blank is provided with a reentrant conical flange and corner configuration similar to flange-corner configuration 27.

Figure 11:
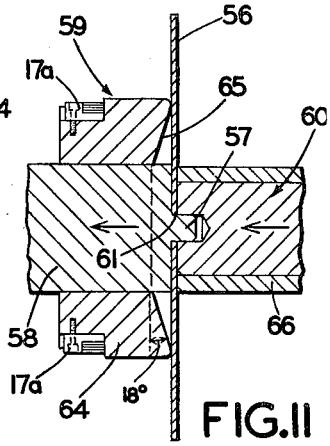
FIG. 11 is a fragmentary, generally diagrammatic sectional view of a flat sheet metal disc blank mounted between headstock and tailstock dies of a spinning machine prior to carrying out the steps of the improved methods to form a modified cup-shaped pulley blank.
Figure 12:
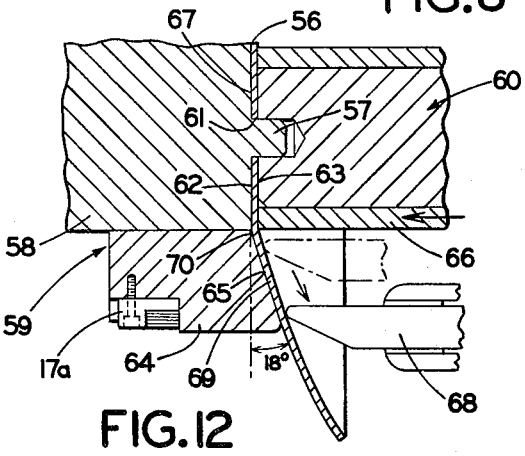
FIG. 12 is an enlarged fragmentary diagrammatic sectional view similar to FIG. 11 showing the tailstock die forming the flat bottom wall portion of the pulley blank upon clamping a central portion of the sheet metal disc against the headstock die form and subsequently roller forming a portion of the conical reentrant flange.
Figure 15:
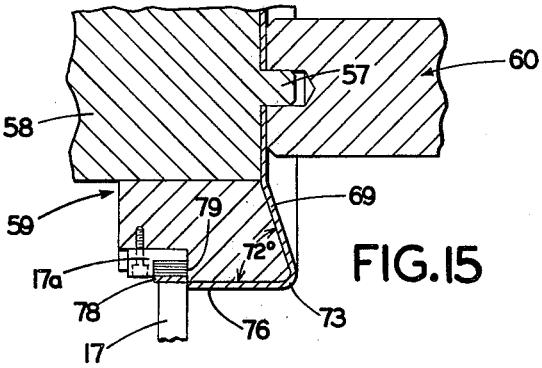
FIG. 15 is a view similar to FIGS. 12–14 showing the trimming operation being performed on the completed axially extending open-ended cylindrical wall of the cup-shaped pulley blank.
Figure 13:
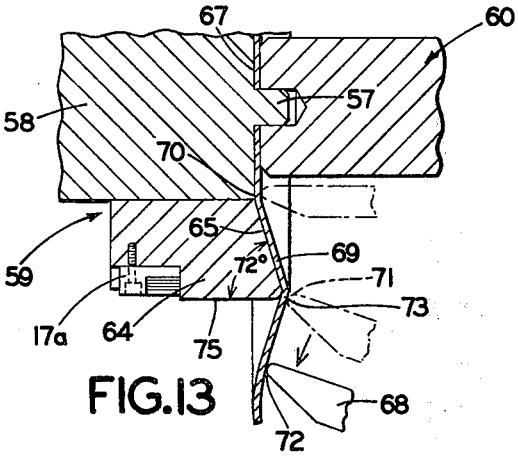
FIG. 13 is a view similar to FIG. 12 showing the steps of roller forming and ironing the reentrant corner in an intermediate portion of the disc adjacent the reentrant flange.
Figure 16:
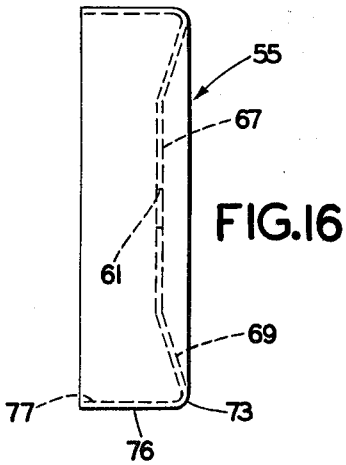
FIG. 16 is an elevational view of the modified form of the roller spun cup-shaped pulley blank formed from the flat metal disc by the steps of the procedure shown in FIGS. 11–15.

FIGS. 11–15 illustrate the spin forming of a modified pulley blank 55 shown in FIG. 16 by the improved method. The blank 55 does not include the axially extending cylindrical hub wall 34 of blank 47. A sheet metal disc 56 similar to disc 20, is placed on a pilot pin 57 of a sliding mandrel 58 which forms a central portion of a headstock die 59. The central portion of disc 56 is clamped on mandrel 58 by a tailstock die 60 (FIG. 11). The central portion of disc 56 surrounding a central pilot pin hole 61 is clamped between complementary circular flat faces 62 and 63 of headstock and tailstock dies 59 and 60, respectively (FIG. 12).

Tailstock die 60 is moved axially toward headstock die 59 by a hydraulic actuated piston or the like (not shown), sliding mandrel 58 within an axially stationary conical ring-shaped die portion 64 of headstock die 59. The pressure exerted by tailstock die 60 forces an annular portion of disc 56 surrounding the central clamped die portion, against and in general conformance with a conical reentrant flange wall 65 formed on ring-shaped die portion 64 of headstock die 59 (FIGS. 11 and 12).

Tailstock die 60 may include an axially movable concentric ring-like portion 66 (FIGS. 11 and 12) which moves axially against an annular portion of disc 56 adjacent the central clamped area to form the entire flat bottom wall portion 67 of cup-shaped blank 55 by press forming. Alternately, this annular area of disc 56 surrounding the clamped central portion may be roller spun by a pressure roller 68, if desired without departing from the concept of the invention. Preferably, this central annular area is roller spun to provide a more completely dynamically balanced cup-shaped blank as shown by dot-dash lines in FIG. 13.

Figure 14:
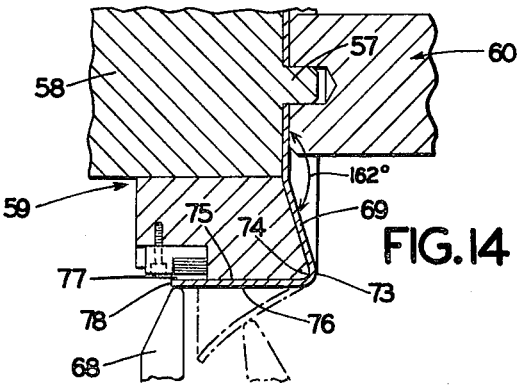
FIG. 14 is a view similar to FIGS. 12 and 13 showing the steps of laying the outer end portion of the disc along the headstock die form completing the formation of the reentrant corner and the cylindrical flange side wall of the cup-shaped pulley blank.

Heatstock and tailstock dies 59 and 60 are rotated and pressure forming roller 68 is moved into pressure engagement with the unclamped portion of disc 56 adjacent tailstock die 60. Roller 68 moves generally radially outwardly from the inner dot-dash line position of FIG. 12 to the outer full line position while pressure rolling, forming and ironing an intermediate annular metal portion of disc 56 against the reversely angled conical flange wall 65 of die portion 64. This metal working procedure forms a complementary reentrant conical flange 69 in disc 56. Flange 69 is joined to the central flat bottom wall portion 67 of disc 56 by a corner 70 forming an obtuse angle of approximately 162° between flat wall portion 67 and conical flange 69 (FIG. 14).

Pressure roller 68 continues to move radially outwardly and axially forward toward heatstock die 59 from the dot-dash line position 71 (FIG. 13) to a full line position 72 partially forming an acutely angled reentrant corner 73 in the disc blank about a complemantary angled corner 74 formed on headstock die 59. Roller 68 then pressure forms and irons the rotating disc metal portion located outwardly of reentrant corner 73, about die corner 74 and against an axially extending cylindrical side wall 75 of headstock die 59 (full lines, FIG. 14) completely forming reentrant corner 73 and a blank cylindrical side wall flange 76 which terminates in an open end 77.

The axially extending cylindrical side wall flange 76, thus is connected to the reversely angled conical flange 69 by reentrant corner 73 which is acutely angled in cross section by approximately 72° (FIG. 15), similar to cylindrical side wall 42, flange 38 and corner 44 of cup-shaped blank 47. Likewise, the metal thickness of side wall flange 76, conical flange 69 and reentrant corner 73 is the same as the thickness of starting disc blank 56, as shown in FIGS. 11–16.

End portion 78 of side wall 76 then is trimmed by trimming wheel 17 (FIG. 15) to provide side wall 76 with a predetermined axial length for forming one or more pulley V-grooves. An annular shoulder 79 preferably is formed in die 59, similar to shoulder 46 of die 5, with trim blades 17*a* being mounted adjacent thereto for cooperation with wheel 17 to trim and section end portion 78.

The modified cup-shaped blank 55 (FIG. 16) which is produced by the steps of FIGS. 11–15 consist of flat bottom wall 67 which is connected to axially extending cylindrical side wall 76 by reversely angled conical flange 69 and acutely angled corner 73.

Figure 17:
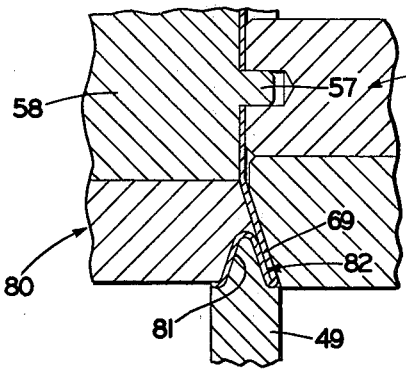
FIG. 17 is a generally diagrammatic, fragmentary view showing the formation of a pulley V-groove in the cylindrical side wall of the modified cup-shaped blank of FIG. 16.

Blank 55 then may be placed on a headstock die 80 of a second pulley forming spinning machine (FIG. 17) located adjacent to or remote from spinning machine 1 whereby roll 49 spins a V-groove 81 in side wall 76. Flange 69 forms one wall thickness of a double thickness flange wall 82 of V-groove 81 in a similar manner as does flange 38 of pulley blank 47.

Figure 18:
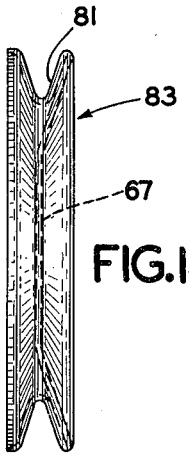
FIG. 18 is an elevational side view of the completed V-grooved pulley formed from the modified cup-shaped pulley blank by the steps of the roller spinning method shown in FIGS. 11–17.

A finished spun V-grooved pulley 83 produced from the dynamically balanced spun cup-shaped blank 55 is shown in FIG. 18 and is of the type in which the flat bottom wall or hub wall 67 is aligned with a plane passing through the bottom of V-groove 81.

Fundamental facets of the new concept involve the procedure for the spinning operations and the manufacture of a dynamically balanced cup-shaped pulley blank with the formation of a reversely angled conical flange which forms a portion of a V-groove in a final spun V-grooved pulley; followed by the spinning of an axially extending cylindrical flange which forms the side wall of the cup-shaped blank, which in turn is connected to the conical flange by a spun corner which is acutely angled in cross section, preferably forming an included angle of approximately 72° between the conical flange and cylindrical flange; and then trimming the open end of the cylindrical flange to a predetermined axial length with respect to the reentrant corner to provide the proper amount of metal for spin forming one or more V-grooves in a final spun pulley.

Spinning machine 1 preferably will be controlled and programmed by pneumatic, hydraulic and electronic components and devices well known in the spinning machine art. An operator need only actuate a cycle start button causing tool holder 11 and trimming assembly 15 to advance through a programmed series of operations to completely spin form a cup-shaped blank 47 and 55. Likewise, headstock die 5 need only be replaced by headstock die 59 with a subsequent reprogramming of the machine control cycle to change from production of pulley blanks 47 to pulley blanks 55.

Headstock die 59 need not comprise a movable mandrel 58 mounted within an outer ring 64, but can be of the less expensive type die formed of a solid integral member having an outer configuration similar to the outer configuration of die assembly 59 shown in FIGS. 12–15.

Accordingly, the present invention provides substantial improvements in the art of making roller spun cup-shaped pulley blanks; provides for the manufacture of a statically and dynamically balanced concentric one sheet metal cup-shaped pulley blank; satisfies the various objects set forth; solves problems and satisfies demands existing in the art; and obtains the new results indicated.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described or to the exact pulley blank shape, dies, rolls and pulleys shown, since they may be varied to provide other structural embodiments.

Having now described the features, discoveries and principles of the invention, the manner in which the new roller spun cup-shaped pulley blanks may be manufactured, the construction and operation of improved roller spinning dies, the details of the steps of improved method, and the advantageous, new and useful results obtained; the new and useful inventions, constructions, devices, parts, elements, arrangements, combinations, sub-combinations, methods, steps, procedures, operations, discoveries, principles and products are set forth in the appended claims.

I claim:

1. In a method of making a cup-shaped sheet metal pulley blank of the type having a bottom wall and a connected outer cylindrical side wall terminating in an open end, from a flat sheet metal disc with pressure roll forming means, for use as a stage blank for forming a V-grooved pulley, including the steps of:

a. providing a flat uniform thickness sheet metal disc having a central hole formed therein;

b. clamping a central portion of the disc around the hole between opposed relatively axially movable complementary clamping faces of rotatable headstock and tailstock die means wherein the headstock die means also has cylindrical flange-forming means and reentrant conical flange forming means connected with the cylindrical flange forming means by a reentrant corner acutely angled in cross section;

c. rotating the die means and clamped disc;

d. reforming the disc into a cup-shaped blank having a flat bottom wall and a connected annular reversely angled conical flange portion terminating in an axially extending open-ended cylindrical side wall portion by pressure rolling, forming and ironing the rotating annular disc metal portions surrounding said central portion against the headstock die means cylindrical and conical flange forming means and the connected reentrant corner;

e. said reforming step including forming a reentrant corner, acutely angled in cross section, connecting said reversely angled conical flange and said axially extending side wall portion;

f. maintaining the thickness of the disc metal during reforming throughout the conical flange portion, the reentrant corner and cylindrical wall portions substantially unchanged from that of the sheet metal disc to provide a cup-shaped blank having substantially uniform thickness conical flange portion, reentrant corner and cylindrical side wall portion; and g. then while continuing rotation of the die means and clamped blank, trimming the open end of the cylindrical side wall to predetermined axial length with respect to the acutely angled reentrant corner.

2. The method set forth in claim 1 in which physical characteristics and gauge variations in the metal disk blank are reduced to uniformity by the pressure forming and ironing of the spinning procedures.

3. The method set forth in claim 1 in which the headstock die means is provided with cylindrical hub forming means extending between the clamping face and reentrant conical flange forming means of the headstock die means; and in which the pressure roll forming means, rolls, forms and irons the rotating annular disc metal portion adjacent the clamped central portion against the headstock die means cylindrical hub forming means to form the cup-shaped blank with an axially extending hub portion connecting the bottom wall with the reversely angled conical flange portion.

4. The method set forth in claim 3 in which the cylindrical hub portion of the metal blank is formed to be concentric with the open-ended cylindrical side wall of the metal blank and to have a smaller diameter than the diameter of said open-ended side wall.

5. The method set forth in claim 3 in which a corner generally right-angled in cross section is formed between the flat bottom wall and the cylindrical hub portion.

6. The method set forth in claim 1 in which the disc blank is roller pressure formed and ironed to form an acutely angled reentrant corner of approximately 72° between the conical flange portion and the cylindrical side wall.

7. The method set forth in claim 1 in which the pressure rolling, forming and ironing of the rotating annular disc metal portion to form the conical flange portion and cylindrical side wall is carried out by a series of passes of the pressure roll forming means moving both axially and radially of and toward portions of the headstock die means.

8. The method set forth in claim 1 in which the headstock die means is provided with a clamping face larger in diameter than the complementary clamping face of the tailstock die means thereby providing a surrounding flat outer annular area; and in which the blank is pressure rolled, formed and ironed by the pressure forming means against said flat outer annular area of the headstock die means in an annular portion of the rotating disc metal surrounding the clamped central portion to form an outer annual area of the blank flat bottom wall.

9. The method set forth in claim 1 in which an obtusely angled corner is formed connecting the conical flange portion directly to and integral with the flat bottom wall.

10. The method set forth in claim 9 in which the obtusely angled corner is formed at an angle approximately 162° between the conical flange portion and the flat bottom wall.

* * * * *

UNITED STATES PATENT AND TRADEMARK OFFICE

CERTIFICATE OF CORRECTION

PATENT NO. : 3,991,598

DATED : November 16, 1976

INVENTOR(S) : Derald H. Kraft

It is certified that error appears in the above-identified patent and that said Letters Patent are hereby corrected as shown below:

Column 1, line 41, change "disc" to -die-;

Column 2, line 30, change "V-groved" to -V-grooved-;

Column 3, line 19, insert the word -a- after "forming";

Column 5, line 9, change "dye" to -die-;

Column 6, line 52, insert the word -of- after "angle";

Column 8, line 10, insert the word -die- after "ring-like";

Column 8, line 21, change "Heatstock" to -Headstock-;

Column 8, line 37, change "heatstock" to -headstock-; and

Column 10, line 57, change "disk" to -disc-.

Signed and Sealed this

First Day of March 1977

[SEAL]

*Attest:*

RUTH C. MASON
*Attesting Officer*

C. MARSHALL DANN
*Commissioner of Patents and Trademarks*